US012012846B2

(12) United States Patent
Barron

(10) Patent No.: US 12,012,846 B2
(45) Date of Patent: Jun. 18, 2024

(54) BOREHOLE GEOMETRY SENSOR AND RUNNING TOOL ASSEMBLIES AND METHODS TO DEPLOY A COMPLETION COMPONENT IN A LATERAL BORE

(71) Applicant: Halliburton Energy Services, Inc., Houston, TX (US)

(72) Inventor: Angus Mackay Barron, Aberdeenshire (GB)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 287 days.

(21) Appl. No.: 17/566,582

(22) Filed: Dec. 30, 2021

(65) Prior Publication Data

US 2023/0212939 A1 Jul. 6, 2023

(51) Int. Cl.

| | |
|---|---|
| ***E21B 47/08*** | (2012.01) |
| ***E21B 7/06*** | (2006.01) |
| ***E21B 41/00*** | (2006.01) |
| ***E21B 47/18*** | (2012.01) |

(52) U.S. Cl.

CPC ..... *E21B 47/08* (2013.01); *E21B 7/061* (2013.01); *E21B 41/0035* (2013.01); *E21B 47/18* (2013.01)

(58) Field of Classification Search

CPC ..... E21B 47/08; E21B 41/0035; E21B 7/061; E21B 47/18

See application file for complete search history.

(56) References Cited

U.S. PATENT DOCUMENTS

| | | | |
|---|---|---|---|
| 3,417,325 | A | 12/1968 | McCullough et al. |
| 3,685,158 | A | 8/1972 | Planche |
| 4,407,157 | A | 10/1983 | Lichtenberg |

(Continued)

FOREIGN PATENT DOCUMENTS

| | | | |
|---|---|---|---|
| EP | 2065553 | A1 | 6/2009 |
| EP | 2844833 | A2 | 11/2013 |

(Continued)

OTHER PUBLICATIONS

Workstring Orientation Tool, Orientation Accuracy in Multilateral Completion Operations, Halliburton Completion Tools, H013700, Dec. 20, 2020.

(Continued)

*Primary Examiner* — Nicole Coy

(74) *Attorney, Agent, or Firm* — Barnes & Thornburg LLP

(57) ABSTRACT

A borehole geometry sensor and running tool assembly includes a borehole geometry sensor sub-assembly configured to determine a borehole geometry of a wellbore. The borehole geometry sensor and running tool assembly also includes a running tool assembly that is initially detachably engaged to the borehole geometry sensor sub-assembly and configured to run the borehole geometry sensor sub-assembly into a borehole, and disengage the borehole geometry sensor sub-assembly after the borehole geometry sensor sub-assembly is run into the borehole. The borehole geometry sensor and running tool assembly further includes a pulse sub-assembly configured to supply power to the running tool assembly, and transmit data obtained by a borehole geometry sensor of the borehole geometry sensor sub-assembly.

19 Claims, 11 Drawing Sheets

(56) References Cited

U.S. PATENT DOCUMENTS

| | | | | |
|---|---|---|---|---|
| 5,415,238 | A * | 5/1995 | Nice | E21B 41/0035 166/381 |
| 6,561,269 | B1 * | 5/2003 | Brown | C09K 8/46 166/97.1 |
| 7,389,828 | B2 | 6/2008 | Ritter et al. | |
| 8,074,511 | B2 | 12/2011 | Huiszoon et al. | |
| 8,091,633 | B2 * | 1/2012 | Al-Khamis | E21B 41/0042 166/250.01 |
| 8,469,084 | B2 * | 6/2013 | Clark | E21B 47/13 340/854.6 |
| 9,217,323 | B2 | 12/2015 | Clark | |
| 9,476,285 | B2 * | 10/2016 | Zhou | E21B 41/0035 |
| 9,885,236 | B2 | 2/2018 | Yu et al. | |
| 9,909,407 | B2 | 3/2018 | Brown-Kerr et al. | |
| 9,963,954 | B2 * | 5/2018 | Al-Mulhem | E21B 41/0035 |
| 10,030,503 | B2 | 7/2018 | Sallwasser et al. | |
| 10,061,049 | B2 * | 8/2018 | Arsalan | G01V 3/28 |
| 2006/0064889 | A1 | 3/2006 | Fredette et al. | |
| 2010/0226206 | A1 | 9/2010 | Al-Khamis | |
| 2012/0061141 | A1 * | 3/2012 | Rossing | E21B 41/0035 175/45 |
| 2012/0067567 | A1 * | 3/2012 | Rytlewski | E21B 41/0085 166/250.01 |
| 2016/0153239 | A1 | 6/2016 | Randall | |

FOREIGN PATENT DOCUMENTS

| | | |
|---|---|---|
| WO | 2013055691 A2 | 4/2013 |
| WO | 2013098321 | 7/2013 |

OTHER PUBLICATIONS

International Search Report and Written Opinion issued on Sep. 21, 2022 in PCT/US2022/011495 (12 pages).

* cited by examiner

BOREHOLE GEOMETRY SENSOR AND RUNNING TOOL ASSEMBLIES AND METHODS TO DEPLOY A COMPLETION COMPONENT IN A LATERAL BORE

BACKGROUND

The present disclose relates generally to borehole geometry sensor and running tool assemblies and methods to deploy a completion component in a lateral bore.

A lateral bore is sometimes drilled from a main bore to improve hydrocarbon production. After the lateral bore is drilled, production tubing is deployed in both the main bore and the lateral bore to increase hydrocarbon production.

BRIEF DESCRIPTION OF THE DRAWINGS

Illustrative embodiments of the present disclosure are described in detail below with reference to the attached drawing figures, which are incorporated by reference herein, and wherein.

Figure 1A:
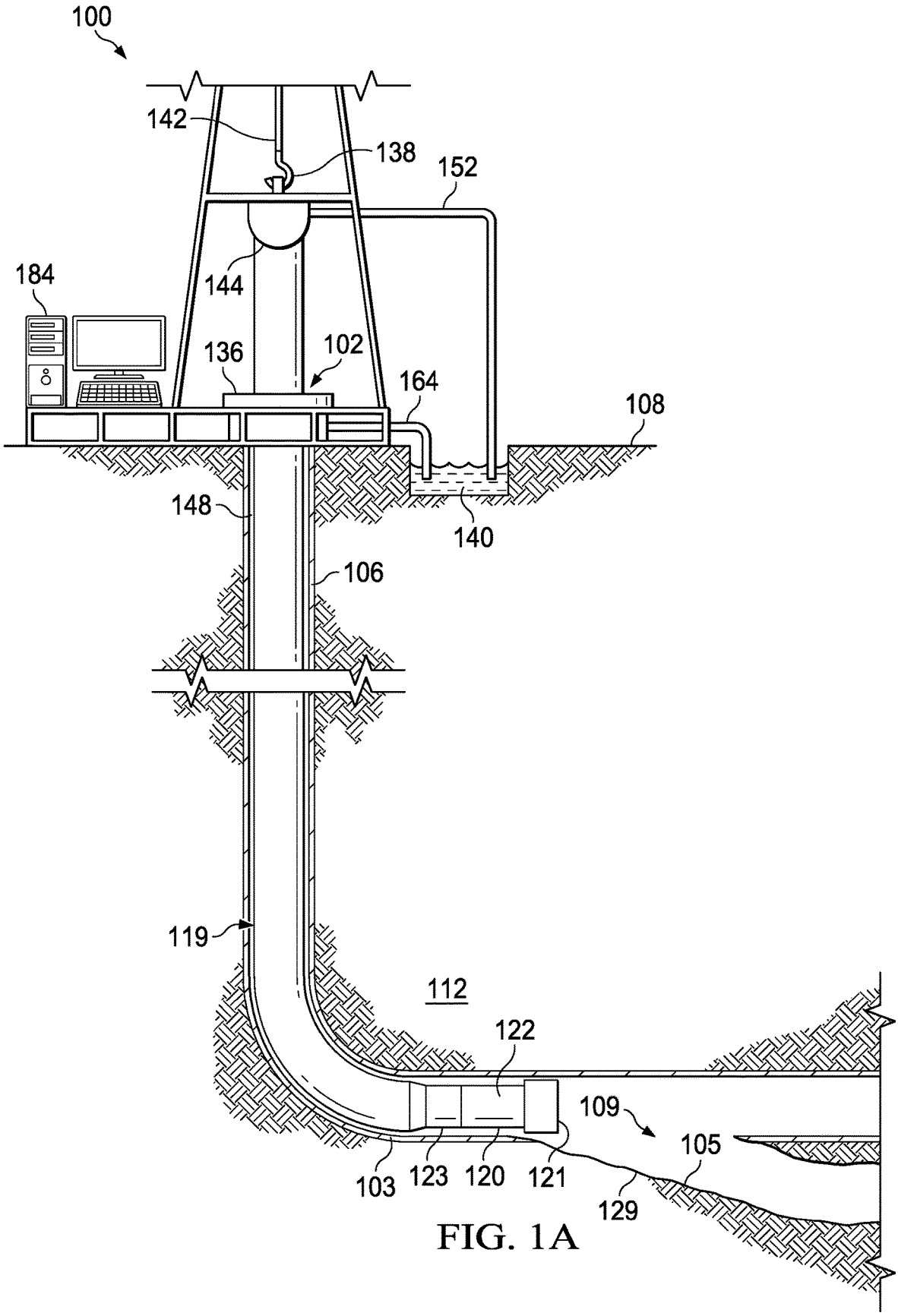
FIG. 1A is a schematic, side view of an environment in which a borehole geometry sensor and running tool assembly that is coupled to a tubular is deployed near a window of a lateral bore of a wellbore having a lowside exit section running into the lateral bore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to borehole geometry sensor and running tool assemblies and methods to deploy a completion component in a lateral bore. The borehole geometry sensor and running tool assembly includes a borehole geometry sensor sub-assembly that is configured to determine a borehole geometry of the wellbore. As referred to herein, borehole geometry includes location and geometrical measurements of the main bore of the wellbore, lateral bore of the wellbore, window of the lateral bore, junction connecting the main bore to one or more lateral bores, an exit section (including low-exit and high-exit) that runs into a lateral bore, and other sections of the main bore, lateral bores, and junctions that connect the main bore to other lateral bores. Further, as referred to herein, geometrical measurements include, but are not limited to, the radius at a location, the angle of inclination or declination, length and width (e.g., length of a window, width of a window, etc.), and other geometrical measurements of sections of the main bore, lateral bores, and junctions that connect the main bore to other lateral bores. In some embodiments, the borehole geometry sensor sub-assembly includes multiple sensor springs that protrude radially outwards from a housing of the borehole geometry sensor sub-assembly, where the borehole geometry sensor sub-assembly is configured to determine borehole geometry at a location of the wellbore based on contact of one or more sensor springs with the wellbore. Additional descriptions of the borehole geometry sensor sub-assembly, components of the borehole geometry sensor sub-assembly, and operations performed by the borehole geometry sensor sub-assembly are provided in the paragraphs below and are illustrated in at least FIGS. 3A-3C.

The borehole geometry sensor and running tool assembly also includes a running tool assembly that is initially coupled to the borehole geometry sensor sub-assembly. The running tool assembly is initially detachably engaged to the borehole geometry sensor sub-assembly and configured to run the borehole geometry sensor sub-assembly to a desired location of the borehole. In some embodiments, where the desired location is in a lateral bore, the running tool assembly traverses through a main bore, through the window of the lateral bore and an exit section (lowside exit or highside exit) that leads to the lateral bore, and to the desired location in the lateral bore. After the running tool assembly has run the borehole geometry sensor and running tool assembly to the desired location, the running tool assembly then disengages or decouples from the borehole geometry sensor sub-assembly, and is retrieved from the lateral bore, leaving the borehole geometry sensor sub-assembly in the lateral bore. In some embodiments, where the borehole geometry sensor and running tool assembly includes or is initially coupled to a completion component (e.g., a deflector), the running tool assembly also disengages or decouples from the completion component, and is retrieved from the lateral bore, leaving the completion component in the lateral bore. In one or more of such embodiments, the running tool assembly also sets or installs the completion component before the running tool assembly is retrieved. For example, where the completion component is a deflector, the running tool assembly sets the deflector at a determined location, then disengages or decouples from the deflector. Additional descriptions of the running tool assembly, components of the running tool assembly, and operations performed by the running tool assembly are provided in the paragraphs below and are illustrated in at least FIG. 4.

The borehole geometry sensor and running tool assembly also includes a pulse sub-assembly that provides power to the running tool assembly. The pulse sub-assembly includes transmitters and/or transceivers that are configured to transmit data obtained by sensors or sensor springs of the borehole geometry sensor sub-assembly indicative of the borehole geometry of the wellbore (borehole geometry data) to a surface-based location, such as to an electronic device of an operator for display and analysis by the operator. The pulse sub-assembly also includes transmitters and/or transceivers that are configured to transmit data indicative of the current speed of the running tool assembly, the current orientation of the running tool assembly, changes to the speed or orientation of the running tool assembly or the borehole geometry sensor sub-assembly, the deployment location of the borehole geometry sensor sub-assembly, and data indicative of operations performed by different components of the borehole geometry sensor and running tool assembly. In some embodiments, the transmitters also transmit data indicative of recommendations on how to operate different components of the borehole geometry sensor and running tool assembly. In some embodiments, the pulse sub-assembly also includes receivers and/or transceivers that are configured to receive data indicative of instructions to switch to different operational modes, and instructions to decouple the borehole geometry sensor sub-assembly and other components that are detachably attached to the borehole geometry sensor and running tool assembly. In some embodiments, the pulse sub-assembly also includes processors that are configured to analyze the borehole geometry data and dynamically provide different components of the borehole geometry sensor and running tool assembly with operational instructions to guide the borehole geometry sensor and running tool assembly to the desired location. Additional descriptions of the pulse sub-assembly, components of the pulse sub-assembly, and operations performed by the pulse sub-assembly are provided in the paragraphs below and are illustrated in at least FIG. 4. Further, additional descriptions of borehole geometry sensor and running tool assemblies and methods to deploy a completion component in a lateral bore are provided in the paragraphs below and are illustrated in the figures.

Figure 1B:
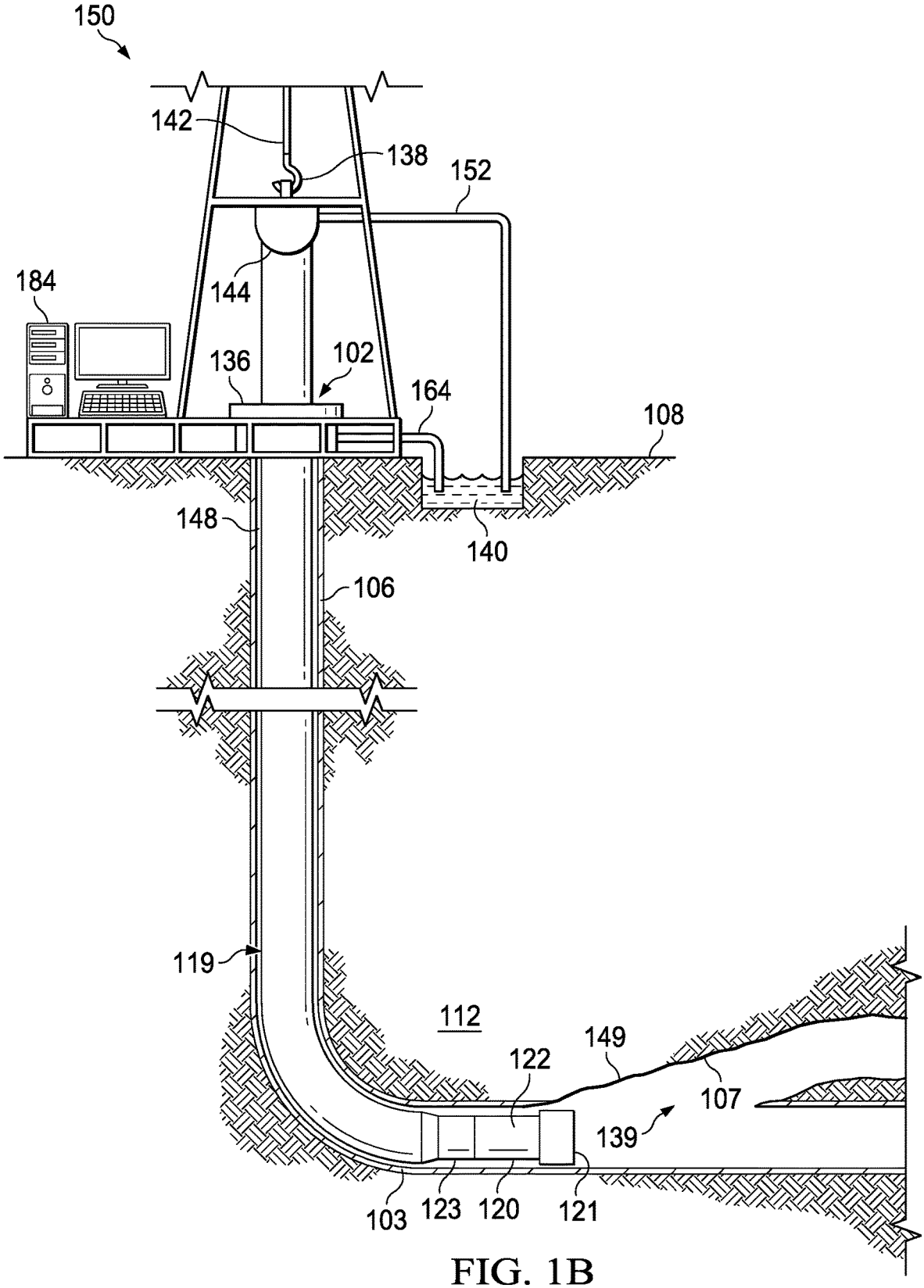
FIG. 1B is a schematic, side view of an environment similar to the environment of FIG. 1A in which a borehole geometry sensor and running tool assembly that is coupled to a tubular is deployed near a window of a lateral bore of a wellbore having a highside exit section running into the lateral bore.

Turning now to the figures, FIG. 1A is a schematic, side view of an environment 100 in which a borehole geometry sensor and running tool assembly 120 that is coupled to a tubular 119 is deployed near a window 109 of a lateral bore 105 of a wellbore 106 having a lowside exit section 129 running into lateral bore 105. FIG. 1B is a schematic, side view of another environment 150 similar to environment 100 of FIG. 1A in which borehole geometry sensor and running tool assembly 120 is coupled to tubular 119 and is deployed near a window 139 of a lateral bore 107 of wellbore 106 having a highside exit section 149 running into lateral bore 107. As referred to herein, a conveyance such as tubular 119 may be coiled tubing, drill pipe, production tubing, or another type of conveyance that has an inner diameter that forms a fluid flow path for fluids to flow downhole. In the embodiments of FIGS. 1A and 1B, a well 102 having wellbore 106 extends from a surface 108 of well 102 to or through a formation 112. In the embodiment of FIG. 1A, wellbore 106 includes a main bore 103 and lateral bore 105 that is connected to main bore 103 via window 109 and lowside exit section 129. Similarly, in the embodiment of FIG. 1B, wellbore 106 includes main bore 103 and lateral bore 107 that is connected to main bore 103 via window 139 and highside exit section 149.

A hook 138, cable 142, traveling block (not shown), hoist (not shown), and top drive 144 are provided to lower a tubular 119 down wellbore 106 of well 102 or to lift tubular 119 up from wellbore 106 of well 102. At a wellhead 136, an inlet conduit 152 is coupled to a fluid source (not shown) to provide fluids, such as drilling fluids, downhole. In the embodiment of FIGS. 1A and 1B, tubular 119 has an internal cavity that provides a fluid flow path from surface 108 to a downhole location.

In some embodiments, the fluids travel down tubular 119 through (one or more ports or internal passageways) borehole geometry sensor and running tool assembly 120, and flow back toward surface 108 through a wellbore annulus 148 and exit the wellbore annulus 148 via an outlet conduit 164 where the fluids are captured in container 140. In some embodiments, tubular 119 also provides telemetry of data indicative of one or more parameters of the well operation or the well 102.

Borehole geometry sensor and running tool assembly 120 includes a borehole geometry sensor sub-assembly 121, a running tool assembly 122, and a pulse sub-assembly 123. As borehole geometry sensor and running tool assembly 120 traverses main bore 103, borehole geometry sensor sub-assembly periodically or continuously performs operations described herein to determine borehole geometry of the wellbore 106 at or near the current location of borehole geometry sensor sub-assembly 121. Borehole geometry data obtained by borehole geometry sensor sub-assembly 121 are transmitted by transmitters and/or transceivers of pulse sub-assembly 123 in real-time via telemetry uphole to controller 184.

As referred to herein, controller 184 is any electronic device that is operable to receive borehole geometry data, and provide borehole geometry sensor and running tool assembly 120 with instructions on when to de-couple or change operating modes based on the borehole geometry data and wellbore position. In some embodiments, controller 184 includes a display that provides the borehole geometry data obtained in real-time for display to an operator. In one or more of such embodiments, the borehole geometry data includes illustrations of the dimensions of main bore 103, dimensions of window 109 of lateral bore 105 and distance to lateral bore 105, dimensions of lowside exit section 129 and distance to lowside exit section 129, dimensions of lateral bore 107, dimensions of window 139 of lateral bore 107 and distance to lateral bore 105, dimensions of highside exit section 149 and distance to highside exit section 149, and dimensions of lateral bore 107. Controller 184 transmits the instructions via telemetry to receivers and/or transceivers of pulse sub-assembly 123. In the embodiment of FIG. 1A, running tool assembly 122 is run into main bore 103, from main bore 103 through window 109 down lowside exit section 129, and to the desired location of lateral bore 105. In the embodiment of FIG. 1A, and after borehole geometry sensor and running tool assembly 120 has traversed to the desired location, controller 184 provides instructions to running tool assembly 122 to disengage or decouple from borehole geometry sensor sub-assembly 121. Running tool assembly 122 and pulse sub-assembly 123 are then reversed out of lateral bore 105 while borehole geometry sensor sub-assembly 121 remains deployed in lateral bore 105. Similarly, in the embodiment of FIG. 1B, running tool assembly 122, is run into main bore 103, from main bore 103 through window 139 up highside exit section 149, and to the desired location of lateral bore 107. In the embodiment of FIG. 1B, and after borehole geometry sensor and running tool assembly 120 has traversed to the desired location, controller 184 provides instructions to running tool assembly 122 to disengage or decouple from borehole geometry sensor sub-assembly 121. Running tool assembly 122 and pulse sub-assembly 123 are then reversed out of lateral bore 107 while borehole geometry sensor sub-assembly 121 remains deployed in lateral bore 107.

In some embodiments, where borehole geometry sensor and running tool assembly 120 is deployed in a completion environment, controller 184 also provides borehole geometry sensor and running tool assembly 120 with instructions to deploy a completion component in lateral bore 105 of FIG. 1A or lateral bore 107 of FIG. 1B before running tool assembly 122 and pulse sub-assembly 123 are reversed out of lateral bore 105 or lateral bore 107, respectively. In some embodiments, controller 184 is a component of borehole geometry sensor and running tool assembly 120, such as a component of pulse sub-assembly 122. In some embodiments, controller 184 is a component of another tool or assembly that is deployed in wellbore 106.

It is understood that borehole geometry sensor and running tool assembly 120 is deployable in different types of well environments, including but not limited to, drilling environments, completion environments, MWD environments, and other applicable well environments. Although FIGS. 1A and 1B each illustrates one lateral bore 105 and 107, respectively, in some embodiments, wellbore 106 includes multiple lateral bores (not shown). In one or more of such embodiments, multiple borehole geometry sensor and running tool assemblies coupled to multiple tubulars (not shown) are deployable through windows to the lateral bores. Further, although FIGS. 1A and 1B each illustrates a cased wellbore 106, in some embodiments, wellbore 106 is uncased. Similarly, although FIGS. 1A and 1B each illustrate an uncased lateral bore 105 and lateral bore 107, respectively, in some embodiments, at least one of lateral bore 105 and lateral bore 107 is cased before borehole geometry sensor and running tool assembly 120 is deployed in wellbore 106.

Figure 2:
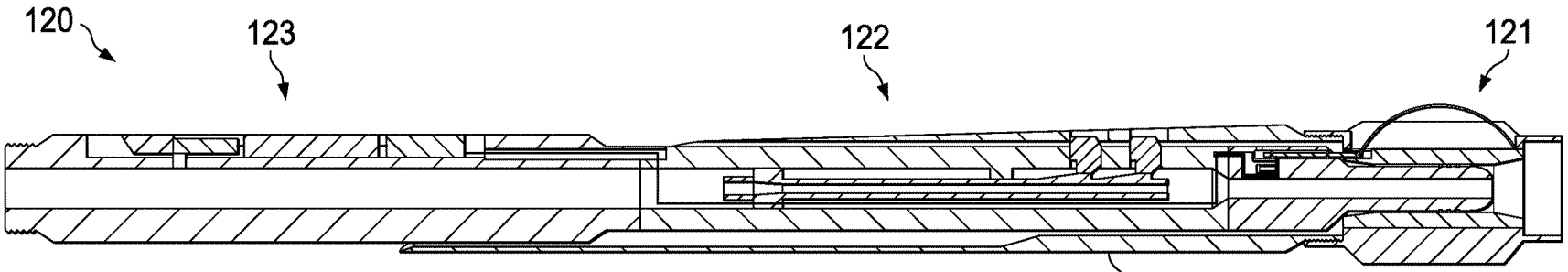
FIG. 2 is a schematic, cross-sectional view of the borehole geometry sensor and running tool assembly of FIGS. 1A and 1B.

FIG. 2 is a schematic, cross-sectional view of borehole geometry sensor and running tool assembly 120 of FIGS. 1A and 1B. In the embodiment of FIG. 2, borehole geometry sensor and running tool assembly 120 includes a borehole geometry sensor sub-assembly 121, a running tool 122, and a pulse sub-assembly 123. Running tool assembly 122 is also detachably coupled to a deflector 202, which remains coupled to running tool assembly 122 until borehole geometry sensor and running tool assembly 120 traverses to a desired location, such as a location to set defector 202. After deflector 202 is positioned at the desired location, running tool assembly 122 sets the deflector, disengages deflector 202 and borehole sensor sub-assembly 121, and is retrieved uphole, leaving deflector 202 and borehole sensor sub-assembly 121 at or near the desired location. In some embodiments, running tool assembly 122 also traverses to a second desired location, such as the location to deploy borehole geometry sensor sub-assembly 121, disengages borehole geometry sensor sub-assembly 121, and is retrieved after leaving deflector 202 and borehole geometry sensor sub-assembly 121 at different downhole locations. Although FIG. 2 illustrates running tool assembly 122 and pulse sub-assembly 123 as separate assemblies, in some embodiments, pulse sub-assembly 123 is a component of running tool assembly 122. Additional descriptions of borehole geometry sensor sub-assembly 121, running tool 122, and pulse sub-assembly 123 are provided herein and are illustrated in at least FIGS. 3A-4.

Figure 3A:
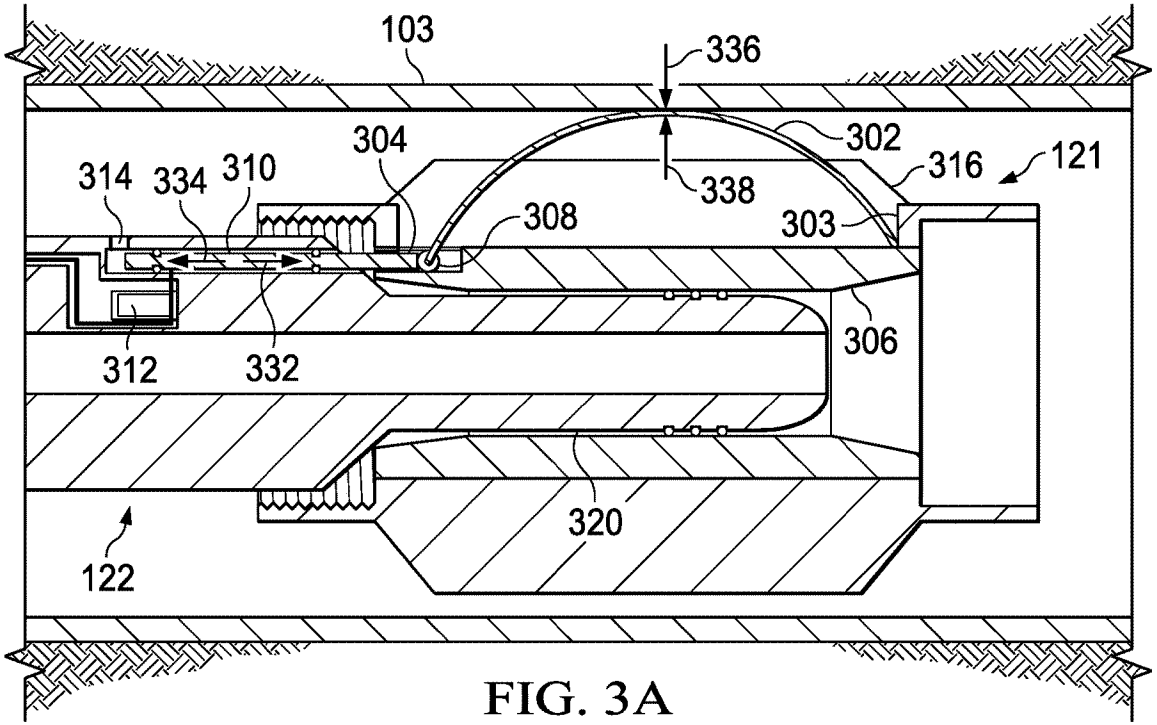
FIG. 3A is a schematic, cross-sectional side view of the borehole geometry sensor sub-assembly of the borehole geometry sensor and running tool assembly of FIG. 2.

FIG. 3A is a schematic, cross-sectional side view of borehole geometry sensor sub-assembly 121 of borehole geometry sensor and running tool assembly 120 of FIG. 2. In the embodiment of FIG. 3A, borehole geometry sensor sub-assembly 121 is coupled to a bull nose 320 of running tool 122. Borehole geometry sensor sub-assembly 121 has a sensor string 302 that is positioned adjacent to a stabilizer 316 that is configured to mitigate damage to sensor string 302. Sensor string 302 has a first end 303 that is coupled to a housing 306 of geometry sensor sub-assembly 121 where first end 303 remains in a fixed position. Sensor string 302 also has a second end 304 that is coupled to a slidable mechanism 308 that is configured to slide in linear directions, such as in directions of arrows 332 and 334. Examples of slidable mechanism include, but are not limited to, balls, cylinders, and other mechanisms configured to linearly slide in response to a threshold amount of force applied to the slidable mechanism. Slidable mechanism 308 in turn is coupled to an actuating rod 310 that is configured to shift in linear directions, such as directions of arrows 332 and 334, in response to force applied by slidable mechanism 308 in the corresponding direction. While the borehole geometry sensor and running tool assembly is traversing a wellbore, compression force applied by the interior diameter of the wellbore, such as by the wellbore wall of main bore 103 to sensor string 302 in a direction illustrated by arrow 336 is translated to slidable mechanism 308, thereby causing slidable mechanism 308 to slide in a direction illustrated by arrow 334. Slidable mechanism 308 in turn applies a force onto actuating rod 310, thereby causing actuating rod 310 to shift in the direction illustrated by arrow 334. When sensor string 302 is no longer in contact with the wall of wellbore 106, force generated by sensor spring 302 returning to a natural position in a direction illustrated by arrow 338 is also translated to slidable mechanism 308, thereby causing slidable mechanism 308 and actuating rod 310 to slide and shift in the direction illustrated by arrow 332. In some embodiments, after actuating rod 310 is shifted in a direction illustrated by arrow 334 and from an original position to a second position, actuating rod 310 is configured to shift in a direction illustrated by arrow 332 to return to the original position if less than a threshold amount of force is applied by slidable mechanism 308.

A positioning sensor 312 of borehole geometry sensor sub-assembly 121 is configured to measure the amount of movement of actuating rod 310, and determine the geometry of main bore 103 at or near the point of contact between main bore 103 and sensor string 302 based on the movement of actuating rod 310. Examples of the geometry of main bore 103 at or near the point of contact include, but are not limited to, the diameter of main bore 103 at the point of contact, the curvature of main bore 103 at the point of contact, the slope of main bore 103 at the point of contact, and other geometrical measurements of main bore 103 at the point of contact. In some embodiments, the dimensions of a wellbore at a location of a sensor spring are determined based on the amount of compression force applied by the wall of a wellbore such as main bore 103 onto the sensor springs, and the current position and state of the sensor springs correspond to the dimensions. For example, where the sensor spring 302 radially extends 1 cm beyond stabilizer 316 and is subject to compression force from main bore 103, then a determination is made that the wall of main bore 103 is 1 cm from stabilizer 316. Borehole geometry sensor sub-assembly 121 also includes a pressure equalizing port 314 that provides communication to actuating rod 310 to counter hydraulic pressure at various depths and to prevent false actuator readings from being made by positioning sensor 312 due to unplanned movement of actuating rod 310.

Figure 3C:
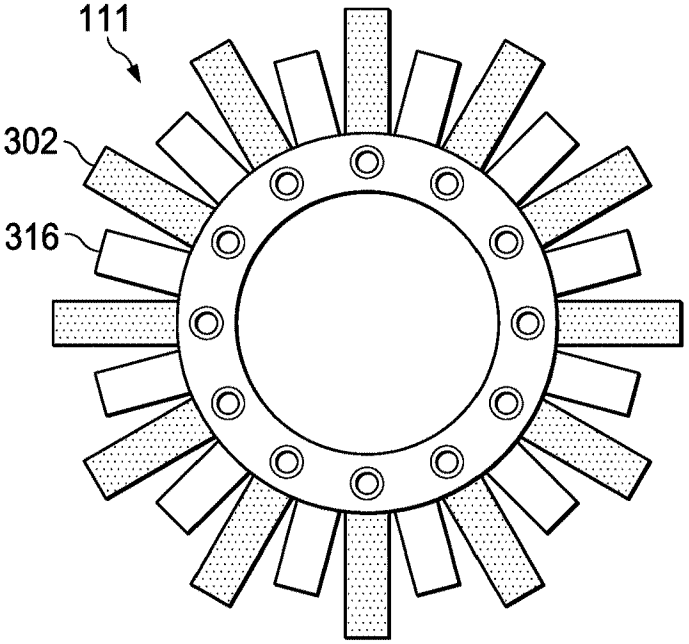
FIG. 3C is a schematic, cross-sectional frontal view of the borehole geometry sensor sub-assembly of FIG. 3A and having a second set of sensor springs deployed.
Figure 3B:
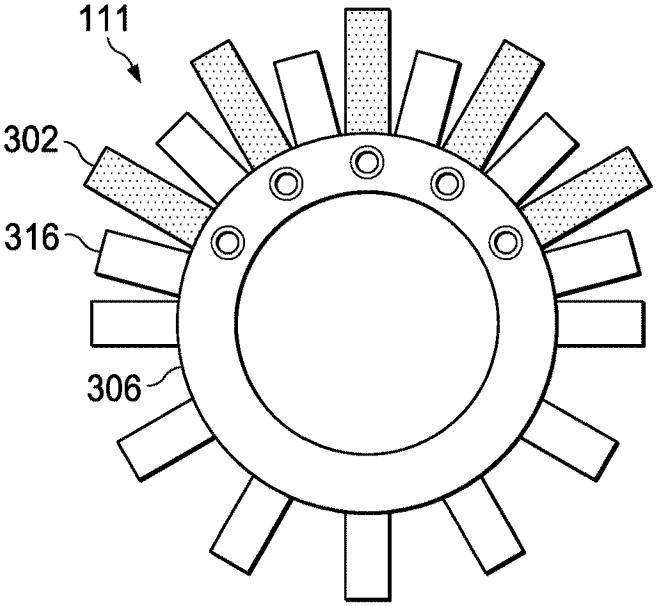
FIG. 3B is a schematic, cross-sectional frontal view of the borehole geometry sensor sub-assembly of FIG. 3A and having a first set of sensor springs deployed.

FIG. 3B is a schematic, cross-sectional frontal view of borehole geometry sensor sub-assembly 121 of FIG. 3A and having a first set of sensor springs deployed radially around a top section of housing 306. In the embodiment of FIG. 3B, five sensor springs including sensor spring 302 are deployed adjacent to stabilizers including stabilizer 316. The sensor springs are arranged on or near the top of borehole geometry sensor sub-assembly 121 to provide high side sensor arrangement for determining the geometry of a section of the borehole at or near the top quarter or half of borehole geometry sensor sub-assembly 121, such as the location and dimensions of window 109, lowside exit section 129, and borehole 105 of FIG. 1A. In some embodiments, borehole geometry sensor sub-assembly 121 of FIG. 3A is re-oriented such that the five sensors are positioned on or near the bottom of borehole geometry sensor sub-assembly 121 to provide highside sensor arrangement for determining the geometry of a section of the borehole at or near the bottom quarter or half of borehole geometry sensor sub-assembly 121, such as the location and dimensions of window 139, highside exit section 149, and borehole 107 of FIG. 1B.

FIG. 3C is a schematic, cross-sectional frontal view of borehole geometry sensor sub-assembly 121 of FIG. 3A and having a second set of sensor springs deployed radially around housing 306. In the embodiment of FIG. 3C, 12 sensor springs including sensor spring 302 are deployed adjacent to stabilizers including stabilizer 316. The sensor springs are arranged radially around 360° of borehole geometry sensor sub-assembly 121 to provide 360° sensing and to determine a 360° geometry of the borehole at or near the location of the sensor springs.

Figure 4:
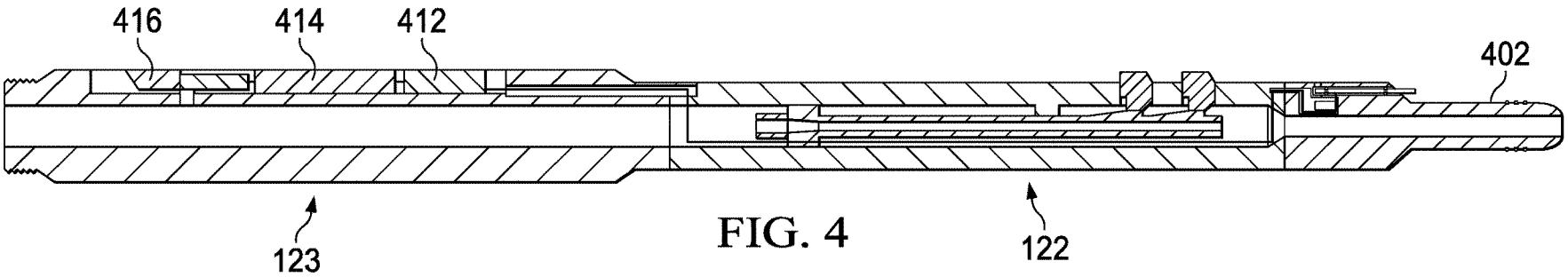
FIG. 4 is a schematic, cross-sectional side view of the running tool assembly and the pulse sub-assembly of the borehole geometry sensor and running tool assembly of FIG. 2.

FIG. 4 is a schematic, cross-sectional side view of running tool assembly 122 and pulse sub-assembly 123 of borehole geometry sensor and running tool assembly 120 of FIG. 2. In the embodiment of FIG. 4, running tool assembly has a bull nose 402 that is initially engaged or coupled to a borehole geometry sensor sub-assembly, such as borehole geometry sensor sub-assembly 121 of FIGS. 3A-3C. After deployment of the borehole geometry sensor sub-assembly to a desired location, bull nose 402 disengages the borehole geometry sensor sub-assembly leaving the borehole geometry sensor sub-assembly at the desired location when running tool assembly 122 is retrieved. In some embodiments, running tool assembly 122 also includes a hydraulic running tool (not shown) that is configured to deploy other components that are initially coupled to the borehole geometry sensor and running tool assembly, such as deflector 202 of FIG. 2.

Pulse sub-assembly 123 includes a decoder 412, a power module 414, and a pulser 416. The decoder is configured to convert borehole geometry data obtained from the borehole geometry sensor sub-assembly, and convert the data into transmissible data. For example, where mud pulse telemetry is used to transmit the data to controller 184 of FIGS. 1A and 1B, decoder 412 translates the borehole geometry data into corresponding mud pulses for transmission via mud pulse telemetry. Power module 414 is configured to provide power to one or more components of the borehole geometry sensor and running tool assembly during operation of the borehole geometry sensor and running tool assembly. Power module 414 is also configured to operate in different modes, such as an "operating" mode, when power module 414 provides power to borehole geometry sensor sub-assembly 121, running tool 122, and pulse sub-assembly, and a "standby" mode, when power module provides power only to certain components of the borehole geometry sensor and running tool assembly. Pulser 416 is configured to generate pulses used to transmit borehole geometry data uphole in real-time. In some embodiments, pulse sub-assembly includes additional transmitters, receivers, and transceivers configured to transmit borehole geometry data uphole in real-time, and to receive instructions on how to operate the borehole geometry sensor and running tool assembly in real-time. In some embodiments, controller 184 dynamically analyzes borehole geometry data for display to an electronic device of an operator. In one or more of such embodiments, controller 184 provides the operator with recommendations on the speed of running tool assembly 122 and orientation of borehole geometry sensor sub-assembly 121, and adjustments to the speed of running tool assembly 122 and orientation of borehole geometry sensor sub-assembly 121 during deployment. In some embodiments, controller 184 of FIG. 1 is a component of pulse sub-assembly 123, such that the borehole geometry sensor and running tool assembly dynamically analyzes borehole geometry data obtained by the borehole geometry sensor sub-assembly, and dynamically makes adjustments based on the borehole geometry data.

Figure 5A:
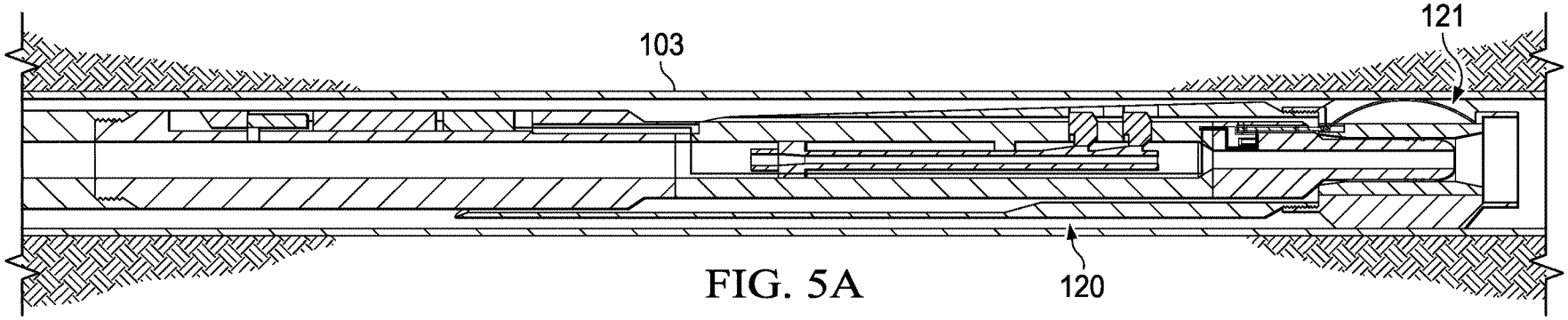
FIG. 5A is a schematic, cross-sectional view of the borehole geometry sensor and running tool assembly of FIG. 1A as the borehole geometry sensor and running tool assembly traverses the main bore of the wellbore of FIG. 1A.
Figure 6B:
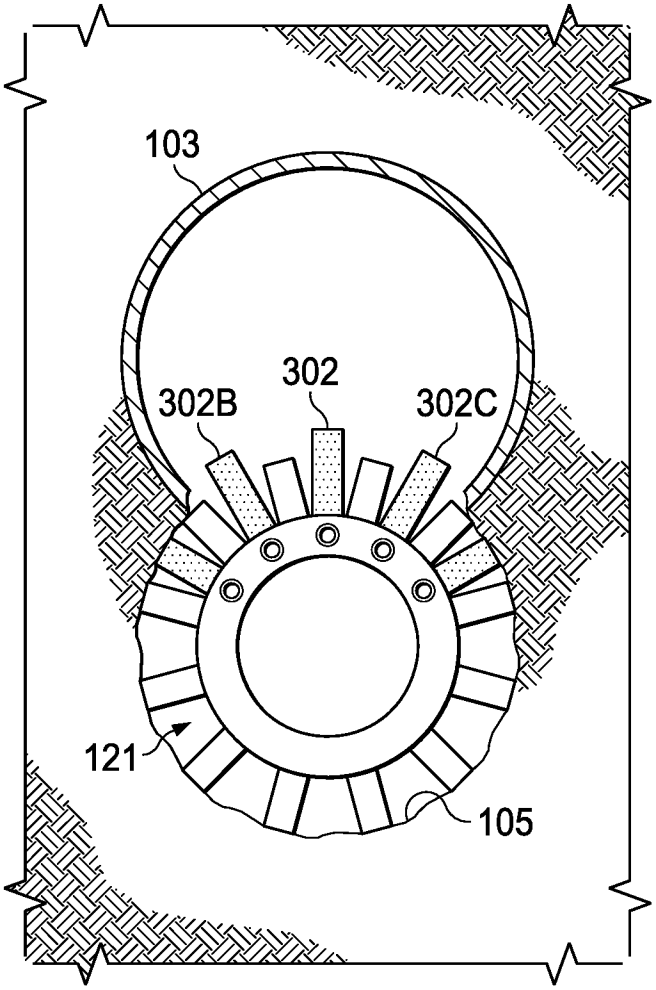
FIG. 6B is a schematic, cross-sectional frontal view of the borehole geometry sensor sub-assembly of FIG. 5B at the location of the wellbore illustrated in FIG. 5B.
Figure 6A:
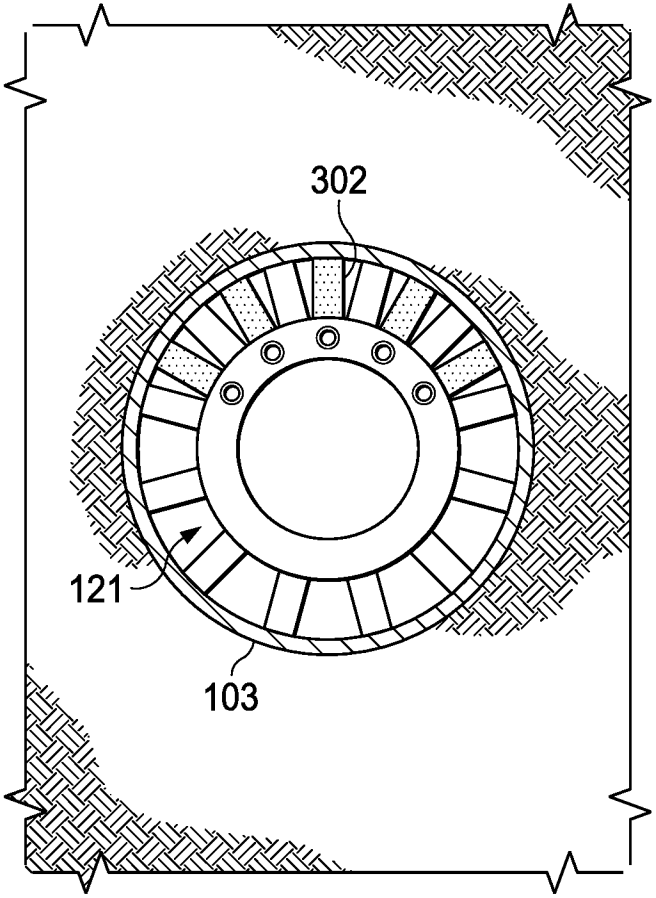
FIG. 6A is a schematic, cross-sectional frontal view of the borehole geometry sensor sub-assembly of the FIG. 5A at the location of the wellbore illustrated in FIG. 5A.
Figure 7B:
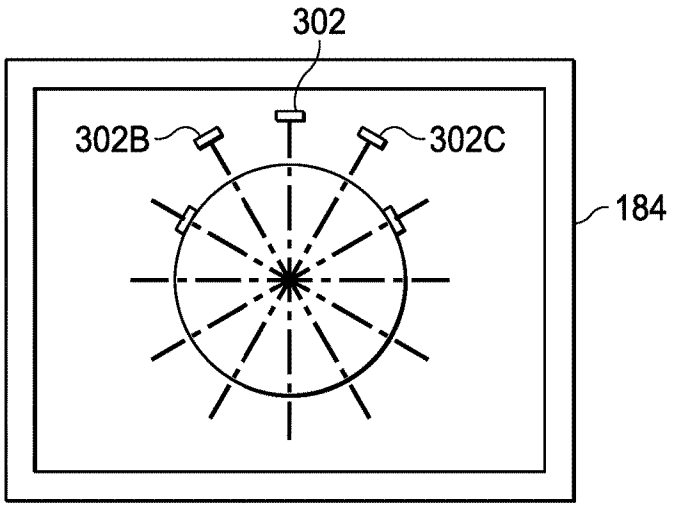
FIG. 7B is an illustration of the deployment configuration of the sensor springs of borehole geometry sensor sub-assembly of FIG. 5B at the location of the wellbore illustrated in FIG. 5B, and displayed on a display of the controller of FIG. 1A.
Figure 7D:
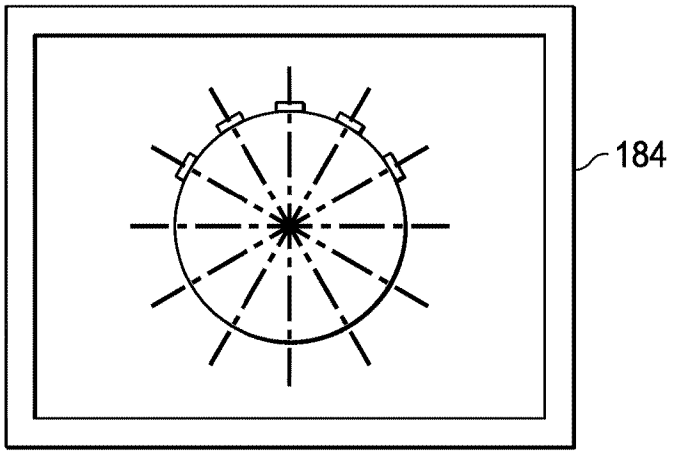
FIG. 7D is an illustration of the deployment configuration of the sensor springs of borehole geometry sensor sub-assembly of FIG. 5D at the location of the wellbore illustrated in FIG. 5D, and displayed on a display of the controller of FIG. 1A.
Figure 7A:
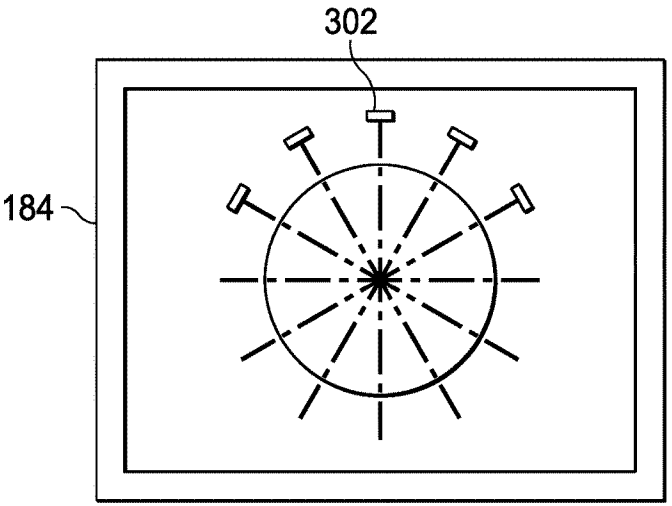
FIG. 7A is an illustration of the deployment configuration of the sensor springs of borehole geometry sensor sub-assembly of FIG. 5A at the location of the wellbore illustrated in FIG. 5A, and displayed on a display of the controller of FIG. 1A.

FIG. 5A is a schematic, cross-sectional view of borehole geometry sensor and running tool assembly 120 of FIG. 1A as borehole geometry sensor and running tool assembly 120 traverses main bore 103. Moreover, FIG. 6A is a schematic, cross-sectional frontal view of borehole geometry sensor sub-assembly 121 of FIG. 5A at the location of main bore 103 as illustrated in FIG. 5A. As shown in FIG. 6A, borehole geometry sensor sub-assembly 121 is completely deployed in main bore 103. Moreover, each of the five sensor springs of borehole geometry sensor sub-assembly 121 including sensor spring 302 are in a contracted position due to compression force applied by the walls of main bore 103. Real-time data indicative of a visualization of the deployment configuration of the sensor springs of borehole geometry sensor sub-assembly 121 are provided uphole. In that regard, FIG. 7A is an illustration of the deployment configuration of the sensor springs of borehole geometry sensor sub-assembly 121 of FIG. 5A at the location of the wellbore illustrated in FIG. 5A, and displayed on a display of controller 184 of FIG. 1A. As illustrated in FIG. 7A, all five sensor springs of borehole geometry sensor sub-assembly 121 of FIG. 5A including sensor spring 302 are in contracted positions, which indicates that borehole geometry sensor sub-assembly 121 remains in main bore 103 of FIG. 1A. Moreover, the deployment configuration of the sensor springs is updated in real-time by borehole geometry sensor and running tool assembly 120, and are provided for display on controller 184 in real-time to help an operator assess the current location of borehole geometry sensor sub-assembly 121 and the geometry of the wellbore at the current location of borehole geometry sensor sub-assembly 121. In some embodiments, adjustments are made (e.g., by an operator on the surface) to the orientation of borehole geometry sensor sub-assembly 121 based on a configuration or dimensions of a junction or lateral bore before borehole geometry sensor and running tool assembly 120 is run into the junction or lateral bore. For example, where the five sensor springs of borehole geometry sensor sub-assembly 121 are positioned on the bottom side of borehole geometry sensor sub-assembly 121, borehole geometry sensor sub-assembly 121 is reoriented such that the five sensor springs are positioned on the top side of borehole geometry sensor sub-assembly 121 as illustrated in FIG. 5A before traversing down lowside exit section 129.

Figure 5B:
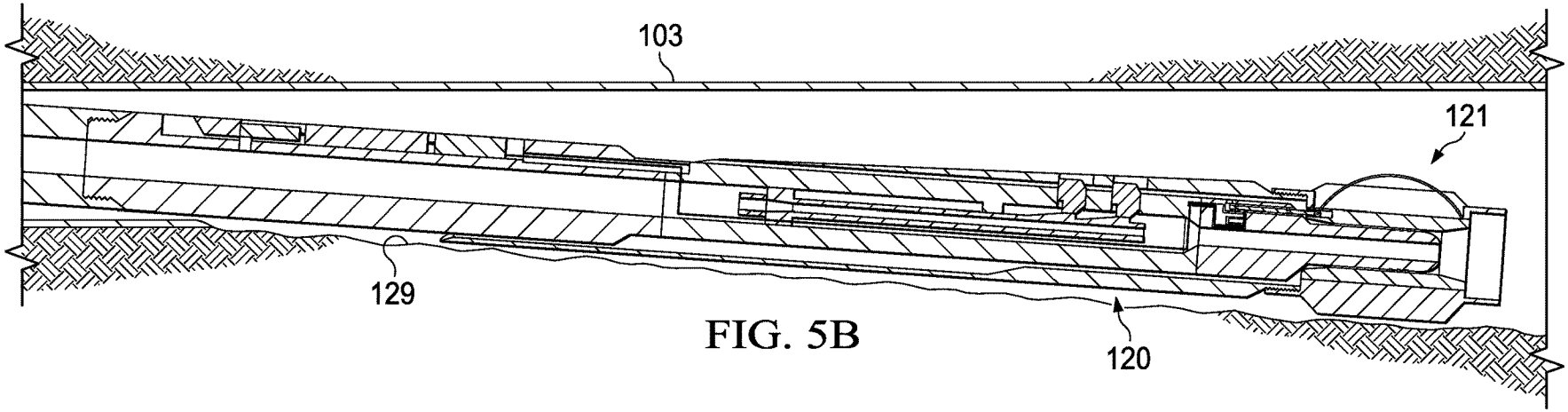
FIG. 5B is a schematic, cross-sectional view of the borehole geometry sensor and running tool assembly of FIG. 5A as the borehole geometry sensor and running tool assembly traverses down a lowside exit section that runs into the lateral bore.

FIG. 5B is a schematic, cross-sectional view of borehole geometry sensor and running tool assembly 120 of FIG. 5A as borehole geometry sensor and running tool assembly 120 traverses down lowside exit section 129 that runs into lateral bore 105 of FIG. 1A. Moreover, FIG. 6B is a schematic, cross-sectional frontal view of borehole geometry sensor sub-assembly 121 of FIG. 5B at the location of the wellbore illustrated in FIG. 5B. As shown in FIG. 6B, a top portion of borehole geometry sensor sub-assembly 121 extends into main bore 103 while the remaining portion of borehole geometry sensor sub-assembly 121 is positioned in lateral bore 105. Moreover, three sensor springs 302, 303B, and 302C of borehole geometry sensor sub-assembly 121 are in extended positions, which indicates that no compression force is applied by the wellbore. Real-time data indicative of a visualization of the current deployment configuration of the sensor springs of borehole geometry sensor sub-assembly 121 are provided uphole. In that regard, FIG. 7B is an illustration of the deployment configuration of the sensor springs of borehole geometry sensor sub-assembly 121 of FIG. 5B at the location of the wellbore illustrated in FIG. 5B, and displayed on the display of controller 184 of FIG. 1A. As illustrated in FIG. 7B, three sensor springs 302, 302B, and 302C of borehole geometry sensor sub-assembly 121 of FIG. 5B are in extended positions, while two other sensor springs are in contracted positions, which indicate that borehole geometry sensor sub-assembly 121 is traversing down lowside exit section 129.

Figure 5C:
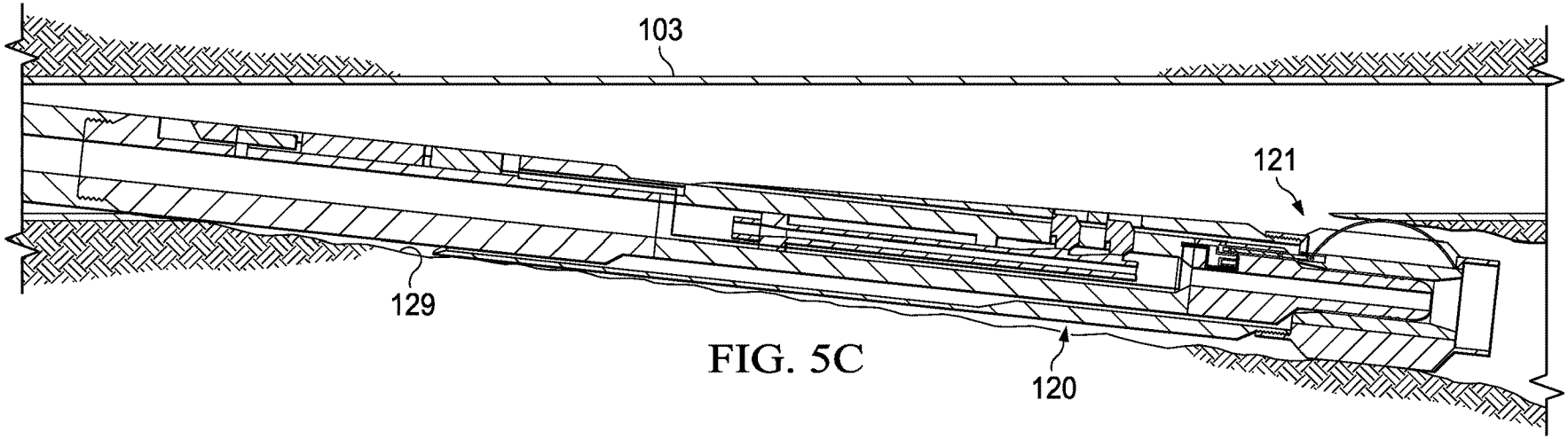
FIG. 5C is a schematic, cross-sectional view of the borehole geometry sensor and running tool assembly of FIG. 5B as the borehole geometry sensor and running tool assembly traverses further down the lowside exit section.
Figure 6D:
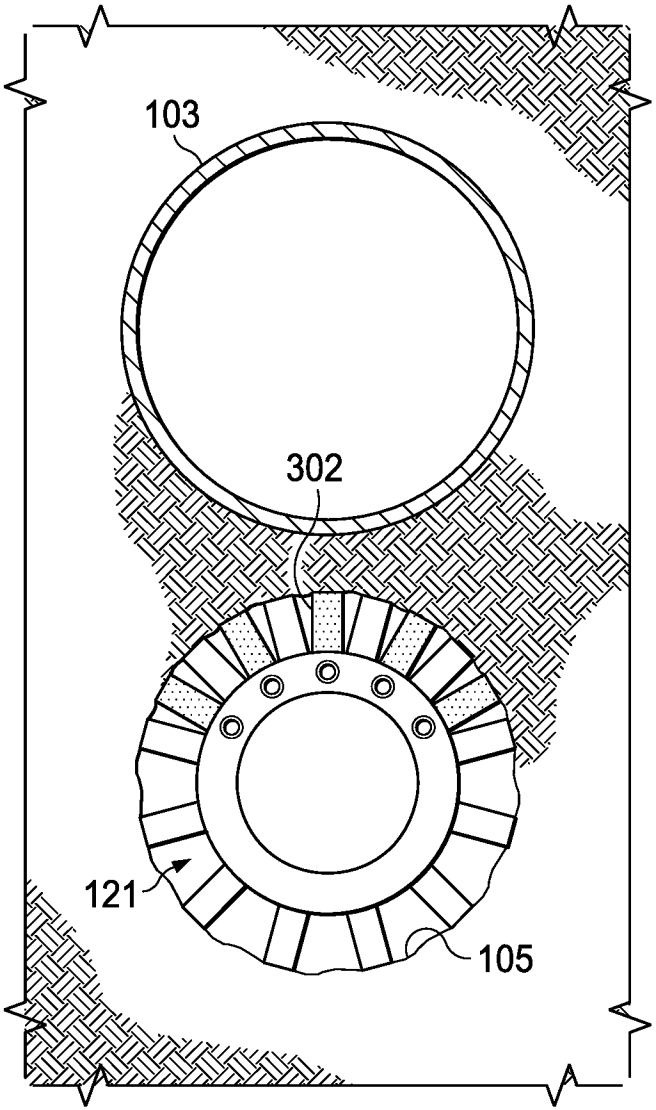
FIG. 6D is a schematic, cross-sectional frontal view of the borehole geometry sensor sub-assembly of FIG. 5D at the location of the wellbore illustrated in FIG. 5D.
Figure 6C:
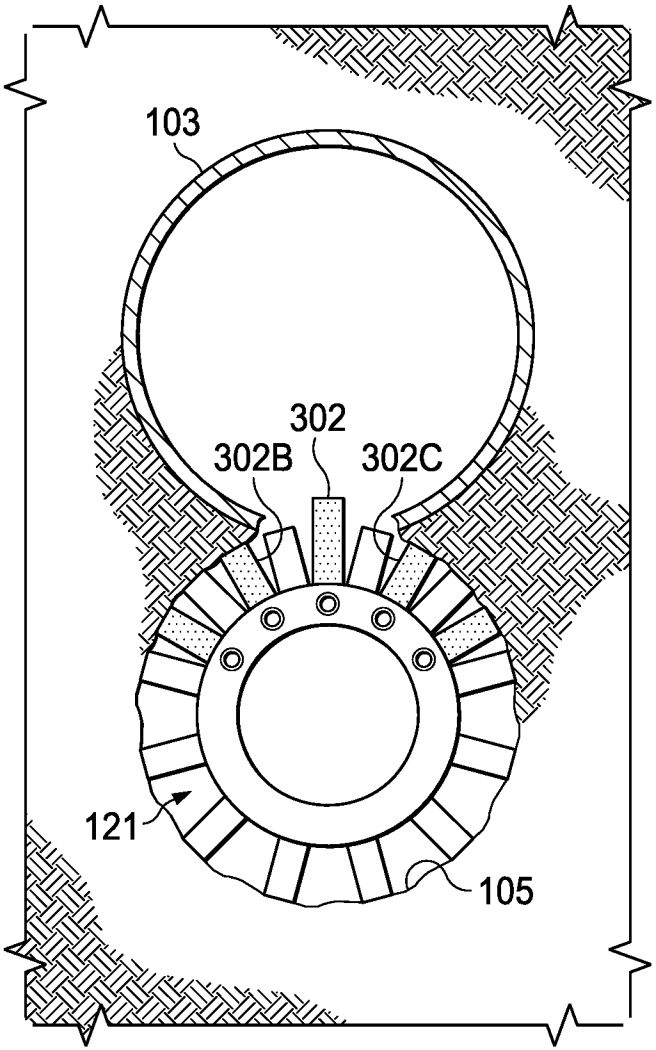
FIG. 6C is a schematic, cross-sectional frontal view of the borehole geometry sensor sub-assembly of FIG. 5C at the location of the wellbore illustrated in FIG. 5C.
Figure 7C:
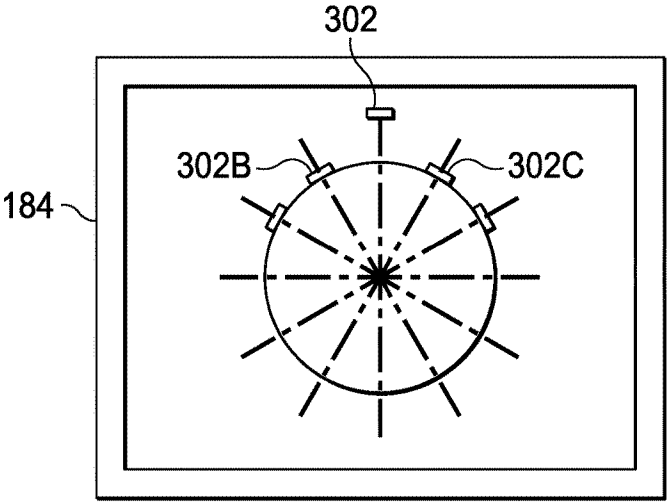
FIG. 7C is an illustration of the deployment configuration of the sensor springs of borehole geometry sensor sub-assembly of FIG. 5C at the location of the wellbore illustrated in FIG. 5C, and displayed on a display of the controller of FIG. 1A.

FIG. 5C is a schematic, cross-sectional view of borehole geometry sensor and running tool assembly 120 of FIG. 5B as borehole geometry sensor and running tool assembly 120 traverses further down lowside exit section 129. Moreover, FIG. 6C is a schematic, cross-sectional frontal view of borehole geometry sensor sub-assembly 121 of FIG. 5C at the location of the wellbore illustrated in FIG. 5C. As shown in FIG. 6C, a top portion of borehole geometry sensor sub-assembly 121 extends into main bore 103 while the remaining portion of borehole geometry sensor sub-assembly 121 is positioned in lateral bore 105. Moreover, one sensor spring 302 of borehole geometry sensor sub-assembly 121 is in an extended position, which indicates that no compression force is applied by the wellbore to sensor spring 320, whereas sensor springs 302B and 302C, which were previously in extended positions while borehole geometry sensor sub-assembly 121 was in the position illustrated in FIG. 6B, are now in contracted positions. The foregoing indicates that borehole geometry sensor sub-assembly 121 has traversed further down lowside exit section 129. Real-time data indicative of a visualization of the current deployment configuration of the sensor springs of borehole geometry sensor sub-assembly 121 are provided uphole. In that regard, FIG. 7C is an illustration of the deployment configuration of sensor springs of borehole geometry sensor sub-assembly 121 of FIG. 5C at the location of the wellbore illustrated in FIG. 5C, and displayed on the display of controller 184 of FIG. 1A. As illustrated in FIG. 7C, one sensor spring 302 of borehole geometry sensor sub-assembly 121 of FIG. 5C is in an extended position, while four other sensor springs are in contracted positions, which indicate that borehole geometry sensor sub-assembly 121 is traversing down lowside exit section 129.

Figure 5D:
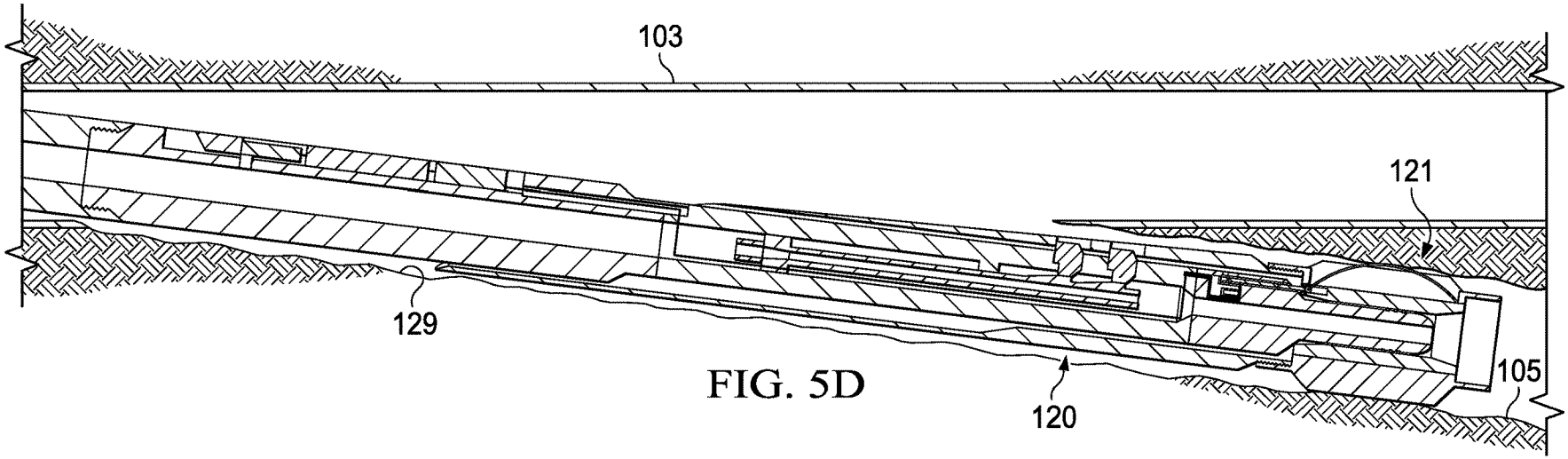
FIG. 5D is a schematic, cross-sectional view of the borehole geometry sensor and running tool assembly of FIG. 5C as the borehole geometry sensor and running tool assembly traverses further down the lowside exit section and into the lateral bore.

FIG. 5D is a schematic, cross-sectional view of borehole geometry sensor and running tool assembly 120 of FIG. 5C as borehole geometry sensor and running tool assembly 120 traverses further down lowside exit section 129 and into lateral bore 105. Moreover, FIG. 6D is a schematic, cross-sectional frontal view of borehole geometry sensor sub-assembly 121 of FIG. 5D at the location of the wellbore illustrated in FIG. 5D. As shown in FIG. 6D, borehole geometry sensor sub-assembly 121 is completely positioned in lateral bore 105, with no portion position in main bore 103. Moreover, none of the five sensor springs of borehole geometry sensor sub-assembly 121 is in an extended position, which indicates that compression force is applied by the wellbore to all five sensor springs. The foregoing indicates that borehole geometry sensor sub-assembly 121 has traversed further down lowside exit section 129 of FIG. 1A and is now positioned inside lateral bore 105. Real-time data indicative of a visualization of the current deployment configuration of the sensor springs of borehole geometry sensor sub-assembly 121 are provided uphole. In that regard, FIG. 7D is an illustration of the deployment configuration of the sensor springs of borehole geometry sensor sub-assembly 121 of FIG. 5D at the location of the wellbore illustrated in FIG. 5D, and displayed on the display of controller 184 of FIG. 1A. As illustrated in FIG. 7D, no sensor spring of borehole geometry sensor sub-assembly 121 of FIG. 5D is in an extended position, which indicates that borehole geometry sensor sub-assembly 121 is traversing down lowside exit section 129 of FIG. 1A and is positioned in lateral bore 105.

Figure 5E:
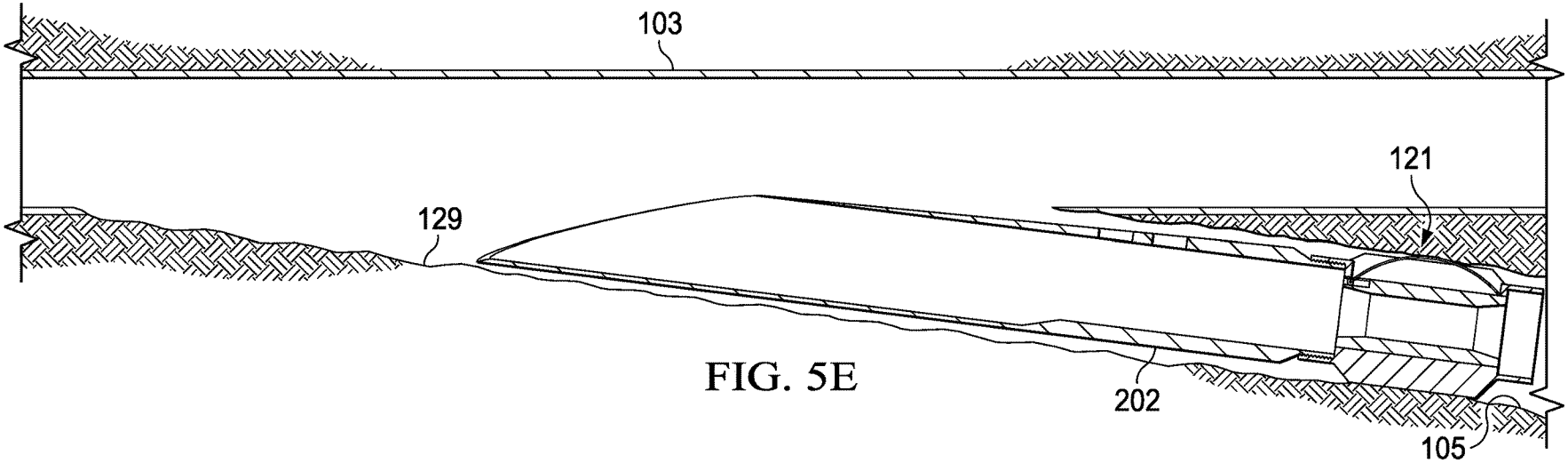
FIG. 5E is a schematic, cross-sectional view of the borehole geometry sensor sub-assembly of FIG. 5D and the deflector after the borehole geometry sensor sub-assembly and the deflector 202 are disengaged from the running tool assembly, and left in the lowside exit section and in the lateral bore.

After borehole geometry sensor and running tool assembly 120 is deployed in a desired location, such as the location of borehole geometry sensor and running tool assembly 120 as illustrated in FIG. 5D, borehole geometry sensor sub-assembly 121 is disengaged or decoupled from borehole geometry sensor and running tool assembly 120 to remain in lateral bore 105 while running tool assembly 122 of borehole geometry sensor and running tool assembly 120 is retrieved. In some embodiments, where a completion component, such as a deflector is coupled with borehole geometry sensor and running tool assembly 120, the completion component is set and then disengaged from borehole geometry sensor and running tool assembly 120 to remain in lateral bore 105 while running tool assembly 122 of borehole geometry sensor and running tool assembly 120 is retrieved. In that regard, FIG. 5E is a schematic, cross-sectional view borehole geometry sensor sub-assembly 121 and deflector 202 after borehole geometry sensor sub-assembly 121 and the deflector 202 are disengaged from running tool assembly 122 and left in lowside exit section 129 and in the lateral bore 105, respectively. In some embodiments, after deflector 202 and borehole geometry sensor sub-assembly 121 are deployed along lowside exit section 129 and in lateral bore, tubing (not shown) and other components are subsequently run down lowside exit section 129 and into lateral bore 105.

Figure 8:
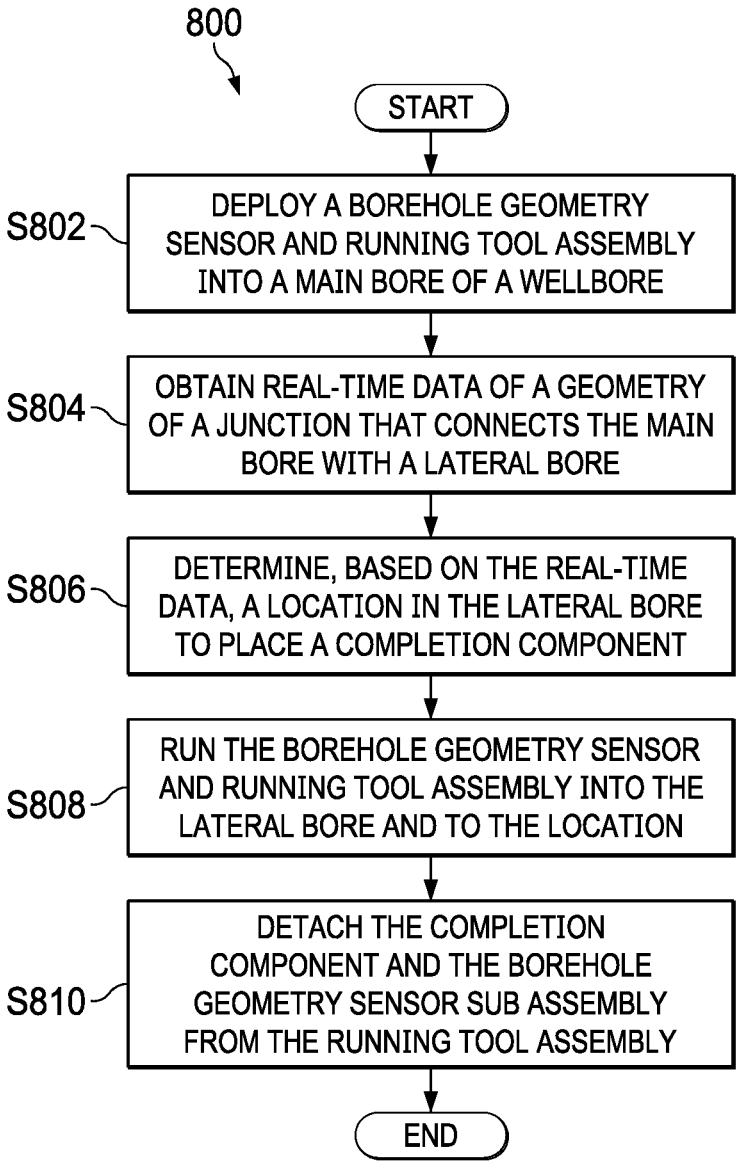
FIG. 8 is a flow chart of a process to deploy a completion component in a lateral bore.

FIG. 8 is a flow chart of a process 800 to deploy a completion component in a lateral bore. Although the operations in the process 800 are shown in a particular sequence, certain operations may be performed in different sequences or at the same time where feasible.

At block S802, a borehole geometry sensor and running tool assembly is deployed into a main bore of a wellbore. In that regard, FIGS. 1A, 1B, and 5A illustrate deploying borehole geometry sensor and running tool assembly 120 into main bore 103 of borehole 106. Further, FIG. 2 illustrates borehole geometry sensor and running tool assembly 120 having a borehole geometry sensor sub-assembly 121, a running tool assembly 122 that is initially detachably engaged to borehole geometry sensor sub-assembly 121, and a deflector 202. At block S804, real-time data of a geometry of a junction that connects the main bore with a lateral bore are obtained. As described herein, borehole geometry sensor sub-assembly 121 is configured to determine different borehole geometries of the wellbore, including the geometry of the junction that connects the main bore with a lateral bore, location of the junction, and other geometric measurements of the junction. Additional descriptions of operations performed by borehole geometry sensor sub-assembly 121 to determine borehole geometry are provided herein and are illustrated in at least FIGS. 3A-3C.

At block S806, real-time data is utilized to determine a location in the lateral bore to place the completion component. In one or more of such embodiments, the real-time data is also utilized to determine a speed to run the borehole geometry sensor and running tool assembly into the lateral bore. In that regard, FIGS. 7A-7D illustrates providing real-time information regarding the deployment configuration of the sensor springs of borehole geometry sensor sub-assembly 121 for display on a display screen of controller 184. In one or more of such embodiments, recommendations to a speed to run running tool assembly 122 and the orientation of geometry sensor sub-assembly 121 are displayed on the display screen of controller 184. In one or more of such embodiments, an operator adjusts the speed to run running tool assembly 122, and adjusts the orientation of geometry sensor sub-assembly 121 based on the location of the junction, the window of the lateral bore, whether the lateral bore is connected to a lowside exit section or highside exit section, and recommendations provided for display on the display screen of controller 184.

At block S808, the borehole geometry sensor and running tool assembly is run into the lateral bore to the determine location. In one or more of such embodiments, the borehole geometry sensor and running tool assembly is run into the lateral bore at a speed and orientation that are based on the real-time data. FIGS. 5B-5D, for example, illustrate running borehole geometry sensor and running tool assembly 120 down lowside exit section 129, and into lateral bore 105. At block S810, the completion component and the borehole geometry sensor sub-assembly are disengaged from the running tool assembly. In that regard, FIG. 5E illustrates borehole geometry sensor sub-assembly 121 and deflector 202 left in lowside exit section 129 and in lateral bore 105 after borehole geometry sensor sub-assembly 121 and deflector 202 are disengaged from running tool assembly 122 of FIG. 1A. In some embodiments, after the running tool assembly is retrieved from the lateral bore, the running tool is subsequently coupled to a second borehole geometry sensor sub-assembly and a second completion component, and the operations described at blocks S802, S804, S806, S808, and S810 are repeated to run the second completion component and the second borehole geometry sensor sub-assembly into the lateral bore or a second lateral bore, and to deploy the second completion component and the second borehole geometry sensor sub-assembly at a second desired location in the lateral bore or the second lateral bore. In some embodiments, after the running tool assembly is retrieved from the lateral bore, a conveyance is subsequently run into the lateral bore. In one or more of such embodiments, the conveyance is run through an opening of the deflector and the borehole geometry sensor sub-assembly.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a borehole geometry sensor and running tool assembly, comprising: a borehole geometry sensor sub-assembly configured to determine a borehole geometry of a wellbore; a running tool assembly that is initially detachably engaged to the borehole geometry sensor sub-assembly, and configured to: run the borehole geometry sensor sub-assembly into a borehole; and disengage the borehole geometry sensor sub-assembly after the borehole geometry sensor sub-assembly is run into the borehole; and a pulse sub-assembly configured to: supply power to the running tool assembly; and transmit data obtained by a borehole geometry sensor of the borehole geometry sensor sub-assembly.

Clause 2, the borehole geometry sensor and running tool assembly of clause 1, wherein the borehole is a lateral bore of the wellbore.

Clause 3, the borehole geometry sensor and running tool assembly of clause 2, wherein the borehole geometry sensor sub-assembly is configured to determine a location of a lateral junction that connects the lateral bore to a main bore of the wellbore and dimensions of the lateral junction.

Clause 4, the borehole geometry sensor and running tool assembly of clause 3, wherein the borehole geometry sensor sub-assembly is configured to determine a window of the lateral bore and dimensions of the window of the borehole.

Clause 5, the borehole geometry sensor and running tool assembly of any of clauses 2-4, further comprising a deflector, wherein the running tool is further configured to: set the deflector in the lateral bore; and disengage the deflector after the deflector is set in the lateral bore.

Clause 6, the borehole geometry sensor and running tool assembly of any of clauses 2-5, wherein the data obtained by the borehole geometry sensor comprises data indicative of a location and geometry of a window of the lateral bore, and wherein the pulse sub-assembly is configured to transmit the data in real-time as the data is obtained by the borehole geometry sensor.

Clause 7, the borehole geometry sensor and running tool assembly of any of clauses 2-6, wherein the data obtained by the borehole geometry sensor comprises data indicative of a location and geometry of a lowside exit section running into the lateral bore, and wherein the pulse sub-assembly is configured to provide the data in real-time as the data is obtained by the borehole geometry sensor.

Clause 8, the borehole geometry sensor and running tool assembly of any of clauses 2-7, wherein the data obtained by the borehole geometry sensor comprises data indicative of a location and geometry of a highside exit section running into the lateral bore, and wherein the pulse sub-assembly is configured to provide the data in real-time as the data is obtained by the borehole geometry sensor.

Clause 9 the borehole geometry sensor and running tool assembly of any of clauses 1-8, wherein the borehole geometry sensor sub-assembly comprises a plurality of sensor springs each configured to determine the borehole geometry of the wellbore based on contact with an interior diameter of the wellbore.

Clause 10, the borehole geometry sensor and running tool assembly of any of clauses 1-9, wherein the running tool assembly comprises a bullnose that is initially detachably engaged to the borehole geometry sensor sub-assembly, and configured to disengage the borehole geometry sensor sub-assembly after the borehole geometry sensor sub-assembly is run into the borehole.

Clause 11, a method to deploy a completion component in a lateral bore, the method comprising: deploying a borehole geometry sensor and running tool assembly into a main bore of a wellbore, the borehole geometry sensor and running tool assembly comprising: a borehole geometry sensor sub-assembly configured to determine a borehole geometry of the wellbore; a running tool assembly that is initially detachably engaged to the borehole geometry sensor sub-assembly; and a completion component; obtaining real-time data of a geometry of a junction that connects the main bore with a lateral bore and a geometry of the junction; determining, based on the real-time data, a location in the lateral bore to place the completion component; running the borehole geometry sensor and running tool assembly into the lateral bore to the location; and disengaging the completion component and the borehole geometry sensor sub-assembly from the running tool assembly.

Clause 12, the method of clause 11, wherein the completion component is a deflector, and the method further comprising setting the deflector at a desired location of the lateral bore, wherein the deflector is disengaged from the running tool assembly after the deflector is set.

Clause 13, the method of clauses 11 or 12, further comprising adjusting, based on the real-time data, an orientation of the borehole geometry sensor and running tool assembly, wherein the borehole geometry sensor and running tool assembly is run into the lateral bore after the orientation of the borehole geometry sensor and running tool assembly is adjusted.

Clause 14, the method of clause 13, further comprising dynamically requesting an adjustment to a speed of the borehole geometry sensor and running tool assembly based on the real-time data.

Clause 15, the method of clause 14, further comprising after disengaging the completion component and the borehole geometry sensor sub-assembly from the running tool assembly, running the running tool assembly out of the lateral bore and into the main bore.

Clause 16, the method of clause 15, further comprising after running the running tool assembly out of the lateral bore, running a conveyance into the lateral bore and through an opening of the completion component and the borehole geometry sensor sub-assembly.

Clause 17, the method of any of clauses 11-16, wherein the geometry of the wellbore comprises a geometry of a window of the lateral bore.

Clause 18, the method of any of clauses 11-17, wherein the junction comprises a lowside exit section into the lateral bore, and the method further comprising determining, based on the real-time data, a speed to run the borehole geometry sensor and running tool assembly through the lowside exit section.

Clause 19, the method of any of clauses 11-18, wherein the junction comprises a highside exit section into the lateral bore, and the method further comprising determining, based on the real-time data, a speed to run the borehole geometry sensor and running tool assembly through the highside exit section.

Clause 20, the method of any of clauses 11-19, further comprising: after disengaging the completion component and the borehole geometry sensor sub-assembly from the running tool assembly, coupling a second borehole geometry sensor sub-assembly to the running tool assembly to form a second borehole geometry sensor and running tool assembly; deploying the second borehole geometry sensor and running tool assembly into the main bore of a wellbore; obtaining real-time data of a geometry of a second junction that connects the main bore with a second lateral bore and a geometry of the second junction; determining, based on the real-time data the geometry of the second junction and the geometry of the second junction, a second location in the second lateral bore to place the second completion component; running the second borehole geometry sensor and running tool assembly into the second lateral bore; and disengaging the second completion component and the second borehole geometry sensor sub-assembly from the running tool assembly.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A borehole geometry sensor and running tool assembly, comprising:

a borehole geometry sensor sub-assembly configured to determine a borehole geometry of a wellbore;

a running tool assembly that is initially detachably engaged to the borehole geometry sensor sub-assembly, and configured to:

run the borehole geometry sensor sub-assembly into a borehole; and disengage the borehole geometry sensor sub-assembly after the borehole geometry sensor sub-assembly is run into the borehole; and a pulse sub-assembly configured to:

supply power to the running tool assembly; and transmit data obtained by a borehole geometry sensor of the borehole geometry sensor sub-assembly.

2. The borehole geometry sensor and running tool assembly of claim 1, wherein the borehole is a lateral bore of the wellbore.

3. The borehole geometry sensor and running tool assembly of claim 2, wherein the borehole geometry sensor sub-assembly is configured to determine a location of a lateral junction that connects the lateral bore to a main bore of the wellbore and dimensions of the lateral junction.

4. The borehole geometry sensor and running tool assembly of claim 3, wherein the borehole geometry sensor sub-assembly is configured to determine a window of the lateral bore and dimensions of the window of the borehole.

5. The borehole geometry sensor and running tool assembly of claim 2, further comprising a deflector, wherein the running tool is further configured to:

set the deflector in the lateral bore; and disengage the deflector after the deflector is set in the lateral bore.

6. The borehole geometry sensor and running tool assembly of claim 2, wherein the data obtained by the borehole geometry sensor comprises data indicative of a location and geometry of a window of the lateral bore, and wherein the pulse sub-assembly is configured to transmit the data in real-time as the data is obtained by the borehole geometry sensor.

7. The borehole geometry sensor and running tool assembly of claim 2, wherein the data obtained by the borehole geometry sensor comprises data indicative of a location and geometry of a lowside exit section running into the lateral bore, and wherein the pulse sub-assembly is configured to provide the data in real-time as the data is obtained by the borehole geometry sensor.

8. The borehole geometry sensor and running tool assembly of claim 2, wherein the data obtained by the borehole geometry sensor comprises data indicative of a location and geometry of a highside exit section running into the lateral bore, and wherein the pulse sub-assembly is configured to provide the data in real-time as the data is obtained by the borehole geometry sensor.

9. The borehole geometry sensor and running tool assembly of claim 1, wherein the borehole geometry sensor sub-assembly comprises a plurality of sensor springs each configured to determine the borehole geometry of the wellbore based on contact with an interior diameter of the wellbore.

10. The borehole geometry sensor and running tool assembly of claim 1, wherein the running tool assembly comprises a bullnose that is initially detachably engaged to the borehole geometry sensor sub-assembly, and configured to disengage the borehole geometry sensor sub-assembly after the borehole geometry sensor sub-assembly is run into the borehole.

11. A method to deploy a completion component in a lateral bore, the method comprising:

deploying a borehole geometry sensor and running tool assembly into a main bore of a wellbore, the borehole geometry sensor and running tool assembly comprising:

a borehole geometry sensor sub-assembly configured to determine a borehole geometry of the wellbore wherein the running tool assembly is initially detachably engaged to the borehole geometry sensor sub-assembly; and a completion component;

obtaining real-time data of a geometry of a junction that connects the main bore with a lateral bore and a geometry of the junction;

determining, based on the real-time data, a location in the lateral bore to place the completion component;

running the borehole geometry sensor and running tool assembly into the lateral bore to the location;

dynamically requesting an adjustment to a speed of the borehole geometry sensor and running tool assembly based on the real-time data; and disengaging the completion component and the borehole geometry sensor sub-assembly from the running tool assembly.

12. The method of claim 11, wherein the completion component is a deflector, and the method further comprising setting the deflector at a desired location of the lateral bore, wherein the deflector is disengaged from the running tool assembly after the deflector is set.

13. The method of claim 11, further comprising adjusting, based on the real-time data, an orientation of the borehole geometry sensor and running tool assembly, wherein the borehole geometry sensor and running tool assembly is run into the lateral bore after the orientation of the borehole geometry sensor and running tool assembly is adjusted.

14. The method of claim 11, further comprising after disengaging the completion component and the borehole geometry sensor sub-assembly from the running tool assembly, running the running tool assembly out of the lateral bore and into the main bore.

15. The method of claim 14, further comprising after running the running tool assembly out of the lateral bore, running a conveyance into the lateral bore and through an opening of the completion component and the borehole geometry sensor sub-assembly.

16. The method of claim 11, wherein the geometry of the wellbore comprises a geometry of a window of the lateral bore.

17. The method of claim 11, wherein the junction comprises a lowside exit section into the lateral bore, and the method further comprising determining, based on the real-time data, a speed to run the borehole geometry sensor and running tool assembly through the lowside exit section.

18. The method of claim 11, wherein the junction comprises a highside exit section into the lateral bore, and the method further comprising determining, based on the real-time data, a speed to run the borehole geometry sensor and running tool assembly through the highside exit section.

19. The method of claim 11, further comprising:

after disengaging the completion component and the borehole geometry sensor sub-assembly from the running tool assembly, coupling a second borehole geometry sensor sub-assembly to the running tool assembly to form a second borehole geometry sensor and running tool assembly;

deploying the second borehole geometry sensor and running tool assembly into the main bore of a wellbore;

obtaining real-time data of a geometry of a second junction that connects the main bore with a second lateral bore and a geometry of the second junction;

determining, based on the real-time data the geometry of the second junction and the geometry of the second junction, a second location in the second lateral bore to place the second completion component;

running the second borehole geometry sensor and running tool assembly into the second lateral bore; and disengaging the second completion component and the second borehole geometry sensor sub-assembly from the running tool assembly.

* * * * *